US008763294B1

(12) United States Patent
Calvert

(10) Patent No.: US 8,763,294 B1
(45) Date of Patent: Jul. 1, 2014

(54) MULTIPLE BULLET AMMUNITION SYSTEM

(71) Applicant: MBAS Associates, Trustee for Multiple Bullet Ammunition System CRT Trust, Manassas, VA (US)

(72) Inventor: S. Mill Calvert, Manassas, VA (US)

(73) Assignee: MBAS Associates, Trustee for Multiple Bullet Ammunition System CRT Trust, Manassas, VA (US)

( * ) Notice: Subject to any disclaimer, the term of this patent is extended or adjusted under 35 U.S.C. 154(b) by 0 days.

(21) Appl. No.: 14/166,528

(22) Filed: Jan. 28, 2014

(51) Int. Cl.
*F42B 5/03* (2006.01)

(52) U.S. Cl.
CPC ..... *F42B 5/03* (2013.01)
USPC ..... 42/50; 102/438

(58) Field of Classification Search
CPC ..... F42B 5/03; F42B 5/035; F42B 5/067; F42B 5/073; F42B 14/065
USPC ..... 42/50; 102/430, 439, 448, 449, 454, 102/489, 501, 516, 517, 438
See application file for complete search history.

(56) References Cited

U.S. PATENT DOCUMENTS 694,896 A * 3/1902 Scott ..... 102/438
2,638,051 A 1/1944 Critchfield
3,065,696 A * 11/1962 Kleinguenther ..... 244/3.23
3,164,092 A 1/1965 Reed et al.
4,448,106 A * 5/1984 Knapp ..... 89/1.11
4,644,865 A 2/1987 Lawrence
4,653,404 A 3/1987 Halverson
4,735,147 A 4/1988 Halverson
4,913,054 A 4/1990 Petersen
5,214,238 A 5/1993 Young
5,339,743 A 8/1994 Scarlata
5,415,102 A 5/1995 White et al.
6,240,850 B1 6/2001 Holler
6,367,387 B1 4/2002 Kruper
7,302,892 B1 12/2007 Meyer et al.

* cited by examiner

*Primary Examiner* — Stephen M Johnson
*Assistant Examiner* — Benjamin Gomberg
(74) *Attorney, Agent, or Firm* — Louis Ventre, Jr.

(57) ABSTRACT

An ammunition system for a firearm includes a cartridge for a firearm, a muzzle-loaded cartridge attachment, a magnet, and a magnetic material. The muzzle-loaded cartridge attachment is loaded into the barrel after the cartridge is loaded in the usual manner. The two are adhered together by magnetic attraction. The cartridge has the magnet, the muzzle-loaded cartridge attachment has the magnet, or both have magnets aligned to draw the two together. When one magnet is present between the two, then the other must have a magnetic material to be drawn to the magnet. To enable more than one muzzle-loaded cartridge attachment to be added, a third magnet may be used within the muzzle-loaded cartridge attachment at the end opposite the cartridge to exert a magnetic field extending toward the muzzle, which will hold the next muzzle-loaded cartridge attachment added to the barrel.

6 Claims, 2 Drawing Sheets

MULTIPLE BULLET AMMUNITION SYSTEM

TECHNICAL FIELD

In the field of ammunition, a multiple bullet ammunition system includes a non-rifling, muzzle-loaded cartridge attachment that is magnetically adhered to the bullet end of a cartridge loaded into the chamber of a firearm.

BACKGROUND ART

The prior art involving more effective bullets discharged from a gun typically involve changes to a cartridge so that the gun sends out projectiles embedded in the cartridge upon firing the cartridge. The cartridge and the projectiles are an integral unit where the cartridge itself contains the projectiles. These prior art solutions are not attachments to a self-actuating cartridge.

Such prior art cartridges also typically incorporate projectiles that are made of materials other than lead. When such projectiles are within the cartridge, they typically involve smaller projectiles that are frangible and either break into individual components on impact, or separate immediately upon firing.

The ammunition system described herein provides a means for multiplying the potential for successful self-defense at close range by adding one or more non-cartridge-embedded projectiles. It uses a cartridge and a subsequently added attachment to the cartridge in any pistol or rifle. Presented with a situation where the shooter wants to increase the chance that a shot will be more effective at disabling a close target than a single bullet from the already-loaded cartridge, the shooter can instantly alter the number of projectiles sent with the use of a single cartridge by adding one or more attachment projectiles through the muzzle of the gun.

The attachment bullet described herein is a sub-caliber projectile that is unimpeded by any rifling in the gun. It would therefore have completely different flight dynamics from the projectile within the cartridge. Regular bullets within cartridges fired from firearms at close range have an excess of energy and momentum and can often pass through a target. Such action does not help with stopping power required to remove the close-in threat. In such circumstances, it is also likely that the bullet will cause unintended damage once it is passes through the target. The attachment bullet described herein shares the propulsive force or energy provided by the propellant in the cartridge, slowing both the bullet in the cartridge and the attachment bullet. However, because two or more projectiles are sent toward the target, it can double the likelihood of substantially disabling or destroying the intended target. Because the energy of the projectiles is shared, it also lessens the chance of the projectiles passing through the target to cause unintended damage.

SUMMARY OF INVENTION

An ammunition system for a firearm includes a cartridge for a firearm, a muzzle-loaded cartridge attachment, a magnet, and a magnetic material. The muzzle-loaded cartridge attachment is loaded into the barrel after the cartridge is loaded in the usual manner. The two are adhered together by magnetic attraction. The cartridge has the magnet, the muzzle-loaded cartridge attachment has the magnet, or both have magnets aligned to draw the two together. When one magnet is present between the two, then the other must have a magnetic material to be drawn to the magnet. To enable more than one muzzle-loaded cartridge attachment to be added, a third magnet may be used within the muzzle-loaded cartridge attachment at the end opposite the cartridge to exert a magnetic field extending toward the muzzle, which will hold the next muzzle-loaded cartridge attachment added to the barrel.

The muzzle-loaded cartridge attachment has a smaller diameter than the cartridge and also has a non-stick, low friction coating forming an exterior surface. This permits the muzzle-loaded cartridge attachment to have a near frictionless fall into the barrel to align up and adhere against the bullet end of the cartridge. The smaller diameter also means that the muzzle-loaded cartridge attachment will not be influenced by any rifling in the barrel.

The muzzle-loaded cartridge attachment is preferably a second bullet, which may take on any form, such as a piercing-cutting point. The muzzle-loaded cartridge attachment may be a shot capsule that releases pellets after the cartridge is fired.

Technical Problem

When it comes to stopping power, the old wisdom that gun instructors teach is: "The More Lead Sent to the Target, the Better." In a military or law enforcement situation, instant stopping power is a time critical factor that often determines whether the enemy or the good guys will go home alive. If machine guns are involved, or if lots of officers or soldiers are involved, then it is not usually a problem to have a combined bullet barrage sufficient to stop an enemy before he inflicts massive casualties.

The same instant stopping power is not available when there is a single police officer involved, who may only have time to get off one shot. If that one shot misses the enemy or hits him in a non-critical area, such as a flesh wound, that officer and all the other innocent people or hostages may all end up dead.

If only there were a way to make the officer's standard issue one-shot-per-trigger-pull service weapon become a weapon that could fire multiple rounds of ammunition with just a single trigger pull. If say, 2, 3 or 4 bullets were all heading to the terrorist at the same time from a single trigger pull, then the odds are greatly increased for instantly killing the terrorist. In this sense, the expression: "There is Safety in Numbers," also applies to numbers of bullets flying toward an enemy.

In many situations involving close-in personal security or law enforcement, a shooter wants to amplify the chance that a shot from a firearm will disable a target. For most existing solutions, this involves pre-loading cartridges suited for that particular purpose. It is not now possible to do so using a muzzle-loaded attachment to the cartridge where the decision to do so can be made at the time of shooting by the shooter.

Individuals engaged in personal protection need to be able to increase the likelihood of hitting a target using a firearm loaded with general purpose cartridges having a single projectile. Such individuals will often also desire to limit collateral damage from the high speed bullet passing through the target.

For example, a homeowner may be faced with hearing a burglar in his home and be confronted with responding to close-in deadly force with his pistol. Also, a law enforcement officer may be confronted with an apartment search for an armed and dangerous felon where there is a good chance of sending a non-disabling single high speed bullet through the felon to cause collateral damage in an adjoining apartment. In both these situations the problem is that existing cartridges cannot be altered to add projectiles or slow the speed of the fired bullet from the cartridge.

There currently is no means to quickly and easily add one or more attachment projectiles to a loaded gun through the muzzle.

Solution to Problem

The solution is a multiple bullet ammunition system that permits a shooter to change the number of projectiles to be shot from a firearm using the same cartridge already loaded in the firearm. The solution uses one or more sub-caliber attachment bullets added to the gun by dropping them into the muzzle so that they are magnetically attached to the cartridge prior to firing the cartridge.

The system disclosed herein is operative in part by magnetic attraction whereby various bullets and projectiles, which are all of a narrow diameter so they can easily slide through the non-rifling diameter of the gun barrel, magnetically attach together and magnetically attach to the primary bullet within the cartridge in the chamber of the gun. When the primary bullet is fired, it pushes out all of the magnetically attached projectiles in front of it. All of the attached projectiles may be coated with a TEFLON or slippery surface coating so they are easily expelled from of the barrel without creating any type of barrel blockage. The primary bullet can either have a small metal part or a magnetic part to enable the piggyback projectiles to magnetically attach thereto.

Preferably, the shape of the leading end and the trailing end of the projectiles have a male and female curvatures, respectively, so they will mate together to improve the hold of the magnetic force prior to discharge, and the discharge path subsequent to firing the cartridge.

In order to use the disclosed system, the officer merely selects a desired projectile for the specific situation from his pouch, points the barrel up and drops in each supplemental projectile. Gravity causes the projectile to slide down the barrel toward the primary bullet and magnetically attach. After firing his selected combination of supplemental projectiles, the officer can choose to keep firing his weapon with the cartridges without added projectiles, or he can decide to modify his choices and add a different combination of supplemental projectiles. This gives the officer a versatile selection of added projectiles to accomplish his task and stay safe.

Advantageous Effects of Invention

The multiple bullet ammunition system will provide a family of muzzle-loaded, sub-caliber bullets, impelled by the discharge of a bullet from a standard cartridge in an ordinary firearm manufactured by others.

The multiple bullet ammunition system will increase the likelihood of disabling a target by adding to the number of projectiles sent to the target. For close-in targets, the system will lessen the chance of a projectile passing through the target and causing collateral damage.

The system described herein is the answer to keep our law enforcement officers and soldiers safe and give multiple-bullet-stopping power has been solved with the disclosure of the multiple bullet ammunition system.

This system can be used on any standard weapon, without any modification at all to the weapon. The officer can now select with each shot, how many bullets or projectiles he wants to send at the enemy.

The system also gives the officer a wide choice of different supplemental projectiles for special purposes that can be fired at the enemy. The officer can fire armor piercing projectiles, cutting projectiles that go through bullet-proof vests, marking projectiles, pellet or birdshot projectiles, a wide assortment of chemical projectiles, such as tranquilizer agent, nerve agent, infectious agent, sleeping agent, poison agent, pepper spray, bleeding agent, etc. The multiple bullet ammunition system will now give our law enforcement and military a choice of added projectile firepower to keep them safe and to win the War on Terror.

The disclosed system turns the standard issue service weapon into a multi-faceted, tool that will help to save many lives and keep America the Land of the Free.

BRIEF DESCRIPTION OF DRAWINGS

The drawings illustrate preferred embodiments of the ammunition system according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
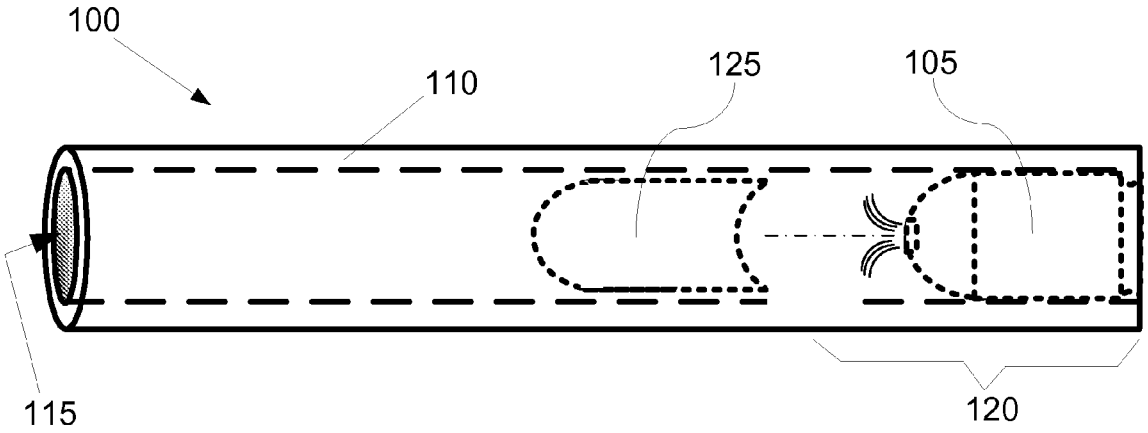
FIG. 1 is a side view of a barrel of a firearm showing a cartridge and a muzzle-loaded cartridge attachment in the form of a bullet within the barrel of the firearm.
Figure 5:
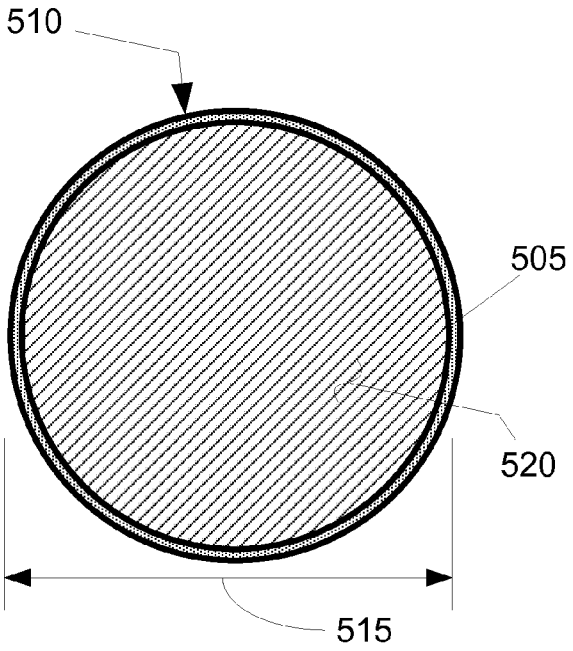
FIG. 5 is a sectional view of the muzzle-loaded cartridge attachment taken along the cut line 5-5 in FIG. 4.

FIG. 1 is a side view of a barrel of a firearm showing a cartridge (105) and a muzzle-loaded cartridge attachment (125) within the barrel (110) of the firearm. The cartridge (105), the muzzle-loaded cartridge attachment (125) together with a first magnet (320), shown in FIG. 3, and a magnetic material (520), shown in FIG. 5, form an ammunition system (100).

Figure 3:
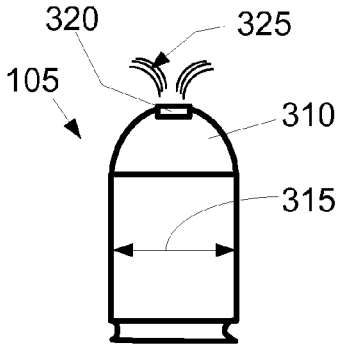
FIG. 3 is an elevation view of the cartridge of FIG. 1.
Figure 8:
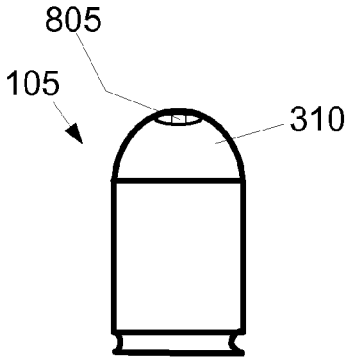
FIG. 8 is an elevation view of a cartridge with a magnetic material within the first bullet.
Figure 9:
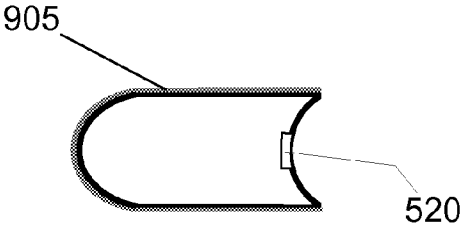
FIG. 9 is a side view of a muzzle-loaded cartridge attachment in the form of a bullet having a magnetic material at its proximal end.

The cartridge (105) includes a first bullet (310) and all the usual components of an operable cartridge that can be discharged in a firearm, such as a propellant, a primer and a case. The cartridge (105) has a first diameter (315) that allows the cartridge (105) to be inserted into a chamber at a rear portion (120) of the barrel (110). The chamber, also known as the firing chamber and a firing cylinder, is the part of the firearm in which the cartridge (105) is inserted prior to being fired. The rear portion (120) is the part of the barrel (110) that is opposite the muzzle (115) of the barrel (110). The muzzle (115) is the open end of the barrel (110) of the firearm. The cartridge (105) may be made with components that are drawn to a magnetic field, or it may be made with all non-magnetic materials. When it is made with non-magnetic materials, then it must be fitted with either a magnet or a magnetic material. The magnet is shown in FIGS. 1 and 3 and the magnetic material, referred to as second magnetic material (805) to avoid confusion, is shown in FIG. 8.

Figure 2:
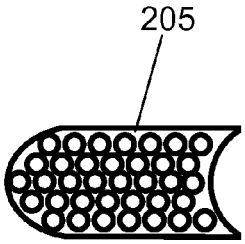
FIG. 2 is a side sectional view of a muzzle-loaded cartridge attachment in the form of a shot capsule.
Figure 7:
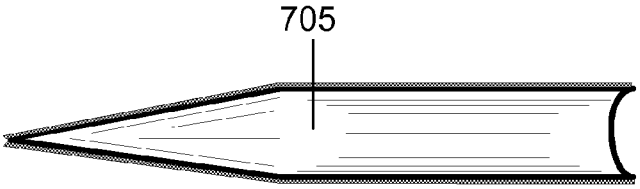
FIG. 7 is a side view of a muzzle-loaded cartridge attachment in the shape of a piercing-cutting point.

The muzzle-loaded cartridge attachment (125) is a separate component from the cartridge (105). The muzzle-loaded cartridge attachment (125) is preferably a second bullet (905) with a shape that mates with, or conforms to the first bullet (310). The second bullet (905) may be in any form, such as for example, a piercing-cutting point (705) shown in FIG. 7, or a shot capsule (205) shown in FIG. 2. The shot capsule (205) is preferably a frangible container holding shot, where the container made of a material that disintegrates when the cartridge is fired so as to permit the shot to spread out on its way to the target. Examples of such material are: compacted, powder-formed containers; paper or thin plastic; and other such brittle or easily broken materials as are well known in the art.

Figure 6:
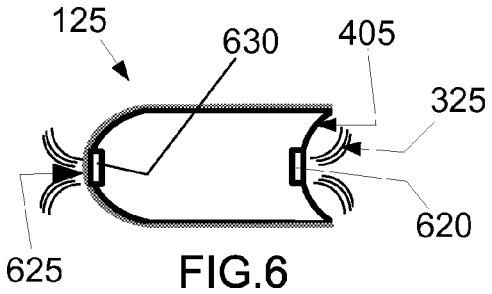
FIG. 6 is a side view of a muzzle-loaded cartridge attachment with a magnet at its proximal end.

The muzzle-loaded cartridge attachment (125) has a proximal end (405) that is adjacent to the first bullet (310) when the muzzle-loaded cartridge attachment (125) is fully inserted into the barrel (110) through the muzzle (115). The cartridge (105) is first loaded into the chamber and then the muzzle-loaded cartridge attachment (125) is inserted into the barrel (110) through the muzzle (115). The proximal end (405) may also be described as the trailing end of the projectile with a leading end (625) opposite thereto and closer to the muzzle (115). Preferably, the shape of the leading end (625) and the proximal end (405) of the projectiles have male and female curvatures, respectively, as shown in FIG. 6, so that they will mate together to improve the hold of the magnetic force prior to discharge, and to improve the discharge path subsequent to firing the cartridge (105).

Figure 4:
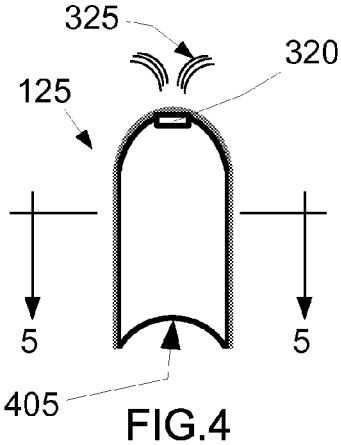
FIG. 4 is a side sectional view of a muzzle-loaded cartridge attachment in the form of a second bullet with a magnet at its leading end.

The muzzle-loaded cartridge attachment (125) may be made of a ferromagnetic or ferrimagnetic substance, such as iron, nickel, cobalt, and some alloys of rare earth metals. Alternatively, muzzle-loaded cartridge attachment (125) may be made of a non-magnetic material, such as copper and lead. When the muzzle-loaded cartridge attachment (125) is itself magnetic, then a magnet (320) may be positioned at its leading end, as shown in FIG. 4.

The muzzle-loaded cartridge attachment (125) has a non-stick, low friction coating (505), such as TEFLON. This non-stick, low friction coating (505) forms an exterior surface (510) at least around the parts of the muzzle-loaded cartridge attachment (125) that can contact the barrel (110) when inserted into the barrel (110). In order that the muzzle-loaded cartridge attachment (125) slides easily into the barrel (110), its diameter is preferably smaller than that of the barrel (110) and also preferably smaller than the diameter of the cartridge (105). For purposes of distinguishing the diameters in this disclosure, the diameter of the muzzle-loaded cartridge attachment (125) is referred to as the second diameter (515) and the diameter of the cartridge (105) is referred to as the first diameter (315). With a smaller diameter, the muzzle-loaded cartridge attachment (125) will not be influenced by the rifling of the barrel and so will be non-rifling. In this sense, it is under-calibered for the barrel (110). Thus, for preferred embodiments, the muzzle-loaded cartridge attachment (125) has a second diameter (515) that is smaller than the first diameter (315).

The first magnet (320) exerts a magnetic field (325) between the proximal end (405) of the muzzle-loaded cartridge attachment (125) and the first bullet (310) when the cartridge (105) is within the chamber and when the muzzle-loaded cartridge attachment (125) is inserted proximal-end-first into the barrel (110) through the muzzle (115). The magnetic field (325) is represented by magnetic field lines shown in FIG. 3.

The first magnet (320) may be located or positioned in either the cartridge (105), preferably within the first bullet (310), and/or within the muzzle-loaded cartridge attachment (125). The first magnet (320) is preferably located in either one of these components at a position close to the boundary of the cartridge (105) and the muzzle-loaded cartridge attachment (125), so that the two components are held together by the magnetic field (325).

In an alternative embodiment, there is a magnet in both components aligned so that the two magnets are attracted to each other. In this embodiment, a second magnet is positioned within either the muzzle-loaded cartridge attachment (125) or the cartridge (105) at a site opposite the first magnet (320), so that the first magnet (320) and the second magnet (620) are attracted to each other. Thus, the ammunition system (100) optionally includes a second magnet (620) positioned within either the muzzle-loaded cartridge attachment or the cartridge at a site opposite the first magnet so that the first magnet and the second magnet are attracted to each other.

So that more than one muzzle-loaded cartridge attachment (125) may be added to the barrel (110), another alternative embodiment includes two magnets in the muzzle-loaded cartridge attachment (125): one in its leading end (625) and one in its proximal end (405), as shown in FIG. 6. The one in its leading end (625) is termed a third magnet to distinguish it from the other potential magnets in the ammunition system (100). This configuration may also aid in eliminating the possibility of inserting the muzzle-loaded cartridge attachment (125) the wrong way through the muzzle (115). Since both ends would have a magnet each would be attracted to second magnetic material (820) in the cartridge.

Thus, the ammunition system (100) may further include a third magnet (630) within the muzzle-loaded cartridge attachment (125), wherein the muzzle-loaded cartridge attachment (125) further comprises a leading end (625) opposite the proximal end (405), and wherein the third magnet (630) is positioned so as to extend its magnetic field from the leading end (625). Preferably, the polarity of the magnetic field extending from the leading end (625) is reversed from the polarity of the field extending from the proximal end (405), so that multiple muzzle-loaded cartridge attachments similarly configured can be linked, end to end. Thus, if the second magnet (620) at the proximal end (405) has a north pole extending a magnetic field (325) outward toward the cartridge (105), then the third magnet (630) at the leading end (625) will have a south pole extending its field outward toward the muzzle (115).

Preferably, the magnetic force holding the muzzle-loaded cartridge attachment (125) and the cartridge (105) together will hold the two components together and prevent the muzzle-loaded cartridge attachment (125) from falling out of the barrel (110) when the barrel (110) is angled toward the ground. Thus, the first magnet (320) is positioned at a point selected from the group consisting of: within the muzzle-loaded cartridge attachment (125), and within the cartridge (105).

The ammunition system (100) includes a magnetic material (520). The magnetic material (520) is simply a substance that is attracted to a magnet, preferably strongly attracted to a magnet. In this sense, the magnetic material (520) may be another magnet as described above. Preferably, the magnetic material (520) is a ferromagnetic or ferrimagnetic substance, such as materials that include iron, nickel, cobalt, and some alloys of rare earth metals. The magnetic material (520) may be the material that is inherently within the cartridge or the muzzle-loaded cartridge attachment (125). In other words, it may be what makes up the cartridge (105) or the muzzle-loaded cartridge attachment (125).

The magnetic material (520) is what is drawn to the first magnet (320). The magnetic material (520) is positioned at a location opposite the first magnet (320). So, if the first magnet (320) is in the cartridge (105), then the magnetic material (520) will be in the muzzle-loaded cartridge attachment (125). Alternatively, if the first magnet (320) is in the muzzle-loaded cartridge attachment (125), then the magnetic material (520) will be located in the cartridge (105), preferably in the first bullet (310) so as to better respond to the pull of the magnetic field from the first magnet (320). Thus, this location is selected from the group consisting of within the cartridge (105), and within the muzzle-loaded cartridge attachment (125).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the firearms industry.

What is claimed is:

1. An ammunition system comprising:

a cartridge for a firearm, the cartridge comprising a first bullet within a case, the bullet having a convex surface extending beyond the end of the case, the cartridge having a first diameter that allows the cartridge to be inserted into a chamber at a rear portion of a barrel, the rear portion being opposite a muzzle of the barrel;

a muzzle-loaded cartridge attachment that is separate from the cartridge, the muzzle-loaded cartridge attachment comprising:

a proximal end that is adjacent to the first bullet when the muzzle-loaded cartridge attachment is fully inserted into the barrel through the muzzle, said proximal end having a concave surface that mates with the convex surface of the first bullet; and a non-stick, low friction coating forming an exterior surface such that the muzzle-loaded cartridge attachment has a second diameter that is smaller than the first diameter;

a first magnet exerting a magnetic field between the proximal end of the muzzle-loaded cartridge attachment and the first bullet when the cartridge is within the chamber and when the muzzle-loaded cartridge attachment is inserted proximal-end-first into the barrel through the muzzle such that gravity causes the muzzled-loaded cartridge attachment to slide down the barrel toward the first bullet to exert said magnetic field, the first magnet positioned at a point selected from the group consisting of within the muzzle-loaded cartridge attachment, and within the cartridge; and a magnetic material drawn to the first magnet and positioned at a location opposite the first magnet, the location selected from the group consisting of within the cartridge, and within the muzzle-loaded cartridge attachment.

2. The ammunition system of claim 1, wherein the muzzle-loaded cartridge attachment is a second bullet.

3. The ammunition system of claim 1, wherein the muzzle-loaded cartridge attachment is a second bullet in the form of a piercing-cutting point.

4. The ammunition system of claim 1, wherein the muzzle-loaded cartridge attachment is a shot capsule.

5. The ammunition system of claim 1, further comprising a second magnet positioned within either the muzzle-loaded cartridge attachment or the cartridge at a site opposite the first magnet so that the first magnet and the second magnet are attracted to each other.

6. The ammunition system of claim 1, further comprising a third magnet within the muzzle-loaded cartridge attachment, wherein the muzzle-loaded cartridge attachment further comprises a leading end opposite the proximal end, and wherein the third magnet is positioned so as to extend its magnetic field from the leading end.

* * * * *